US005085144A

United States Patent [19]

Lindstrom et al.

[11] Patent Number: 5,085,144

[45] Date of Patent: Feb. 4, 1992

[54] INK FOUNTAIN APPARATUS

[75] Inventors: Jan C. R. Lindstrom, Lancaster; Jack Bryer, York; Robert J. Talarico, Mechanicsburg, all of Pa.

[73] Assignee: Motter Printing Press Co., York, Pa.

[21] Appl. No.: 518,658

[22] Filed: May 3, 1990

[51] Int. Cl.[5] ..... B41F 31/04; B41F 31/05

[52] U.S. Cl. ..... 101/363; 101/366

[58] Field of Search ..... 101/366, 365, 156, 169, 101/350, 364, 363, 207-220; 118/261, 410

[56] References Cited

U.S. PATENT DOCUMENTS 2,151,968 3/1939 Henderson ..... 101/157

2,151,969 3/1939 Henderson ..... 101/157

FOREIGN PATENT DOCUMENTS 0110081 6/1984 European Pat. Off. ..... 101/366

*Primary Examiner*—J. Reed Fisher

*Attorney, Agent, or Firm*—Brumbaugh, Graves, Donohue & Raymond

[57] ABSTRACT

An ink fountain having doctor blades clamped on the upstream and downstream sides to engage a rotary cylinder and an overflow ink barrier at one end of the ink fountain providing an overflow wall for the discharge of ink from the ink fountain into a drain chamber. Longitudinal channels beneath the doctor blades communicate with the drain chamber for the discharge of ink into the drain chamber.

6 Claims, 4 Drawing Sheets

INK FOUNTAIN APPARATUS

BACKGROUND OF THE INVENTION

This invention relates to an ink fountain apparatus for supplying ink from an ink reservoir to a rotating cylinder of a printing press, and more particularly, to a novel ink fountain apparatus in which an ink fountain is provided beneath the rotating cylinder for applying ink to the cylinder and in which a continuous flow of ink is maintained from the ink fountain into a drain chamber of an end cap located at the end of the cylinder.

Although the invention may have a more general application, it is particularly applicable to flexographic printing presses which embody impression, plate and anilox cylinders and in which ink is supplied to the anilox cylinder by an ink fountain located beneath the anilox cylinder and interposed between two doctor blades which wipe ink from the cylinder. In conventional printing presses of this type, ink seals are provided at both ends of the ink fountain to contain the ink.

The ink sealing arrangements generally used for printing presses of this type have included 1) seals which contact the outer surface of the cylinder near the ends, and 2) seals which encase the anilox cylinder. The former arrangement generates heat, causing ink drying in areas which require cleaning. In the latter arrangement, due to the tendency of the anilox cylinder to throw ink, the excess ink may either dry or leak from the fountain.

Another problem of ink fountains of this type is that the ink pressure that builds up within the ink fountain affects the wipe of the ink metering doctor blade. Depending upon such factors as blade support, flow of ink and speed of the press, the fountain pressure can vary and change the ink meter of the blade in a manner which is beyond the control of the operator.

Another problem encountered in ink fountain apparatus of printing presses of this type is the phenomenon called "burping", that is, vibration of the ink metering doctor blade in such a manner as to allow an excessive quantity of ink to pass between the anilox cylinder and the doctor blade, allowing the ink film to be much thicker and causing printing problems.

SUMMARY OF THE INVENTION

The object of the invention is to provide a novel and improved ink fountain apparatus that overcomes or minimizes the problems inherent in conventional ink fountain apparatus of the type described above.

In the ink fountain apparatus of the present invention in which the ink fountain is located beneath the rotating cylinder and between upstream and downstream doctor blades, the conventional end seals are eliminated and replaced by ink barriers at the ends of the ink fountain which do not engage either the rotating cylinder or the doctor blades. The ink barriers are located beneath and in closely spaced relation to the rotating cylinder near the ends thereof to maintain a constant overflow of ink from the ink fountain into drain chambers within end caps which return the overflow ink to a storage reservoir.

The ink pressure within the fountain is controlled by a pressure control means which includes a chamber in communication with the ink fountain and an overflow wall within the chamber which maintains a level of ink on the upstream side of the overflow wall to control the pressure within the ink fountain. In this manner, a controlled rate of flow of ink is maintained from the ink fountain between the cylinder and the ink barriers which will prevent drying of the ink.

In the ink fountain apparatus of the present invention, the doctor blades extend beyond the ends of the rotating cylinder to the drain chambers within the end caps so that ink flow along the upper and lower surfaces of the doctor blades will be discharged into the drain chambers of the end caps for return to the storage reservoir.

To maintain controlled uniform pressure of the doctor blades against the rotating cylinder, fluid inflatable tubes are provided for controlling the deflection of the doctor blades against the rotating cylinder. By grooving the doctor blades longitudinally near their clamped edges, the grooves act as hinges so that the inflatable tubes can more effectively control the deflection of the unclamped edges of the blades to provide the desired wipe. The inflatable tubes also make it possible to provide different wipe pressures on the upstream and downstream blades.

DESCRIPTION OF THE DRAWINGS

For a more complete understanding of the present invention, reference can be made to the detailed description which follows and to the accompanying drawings in which.

DETAILED DESCRIPTION OF INVENTION

Figure 1:
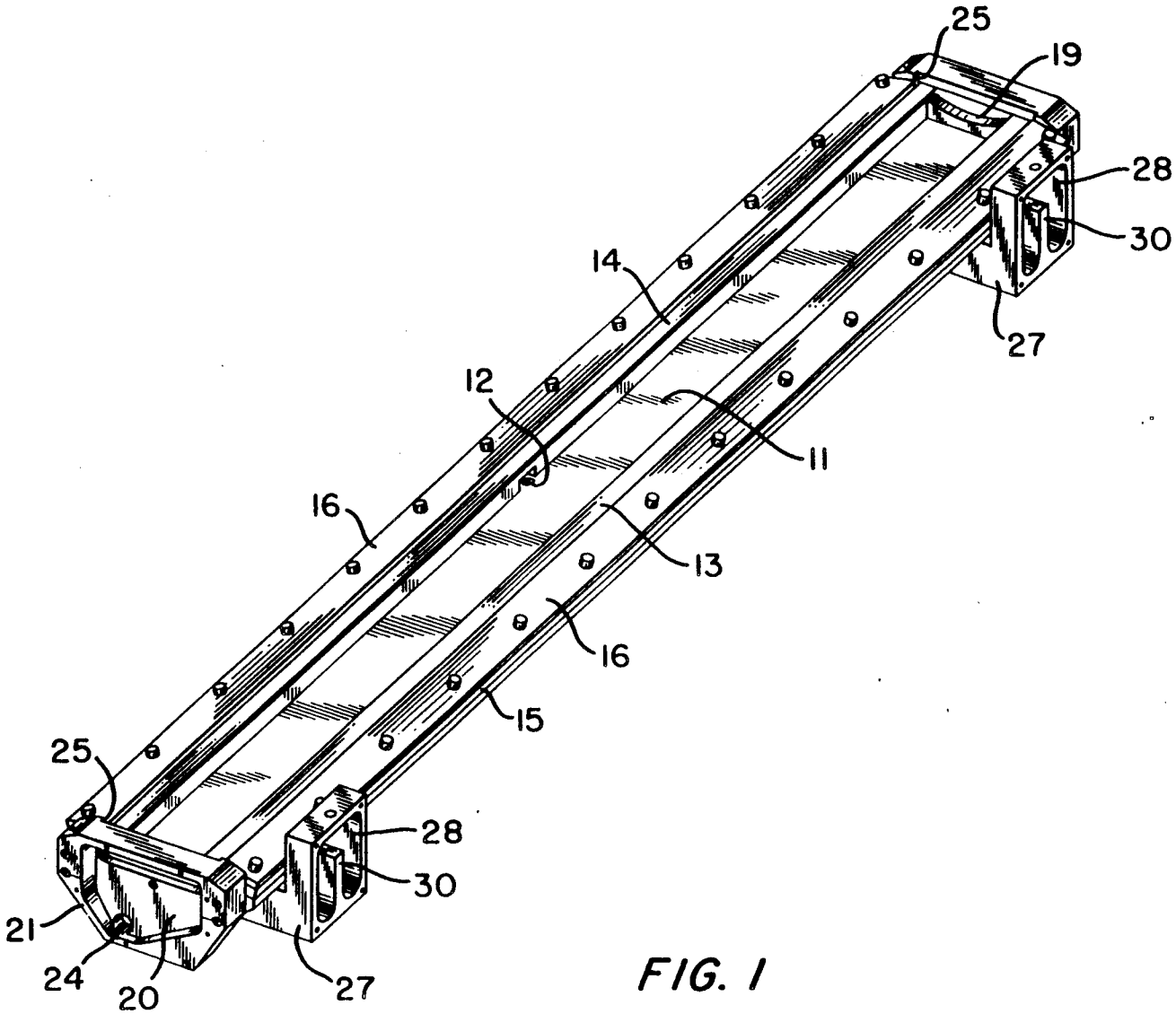
FIG. 1 is an isometric view of the ink fountain apparatus of the present invention with the front end cap cover removed.
Figure 2:
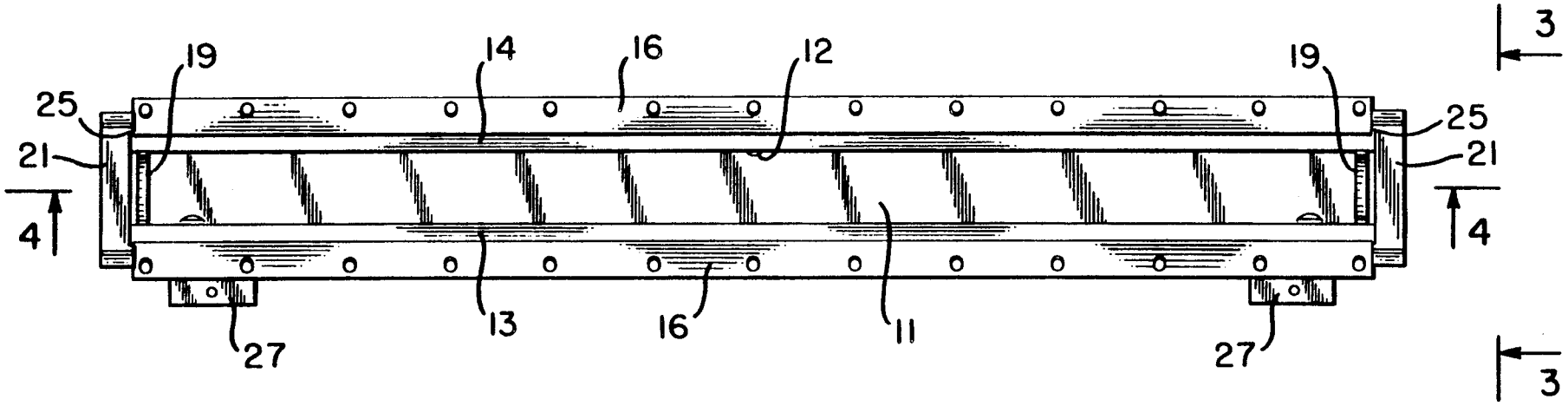
FIG. 2 is a plan view of the ink fountain apparatus shown in FIG. 1.
Figure 3:
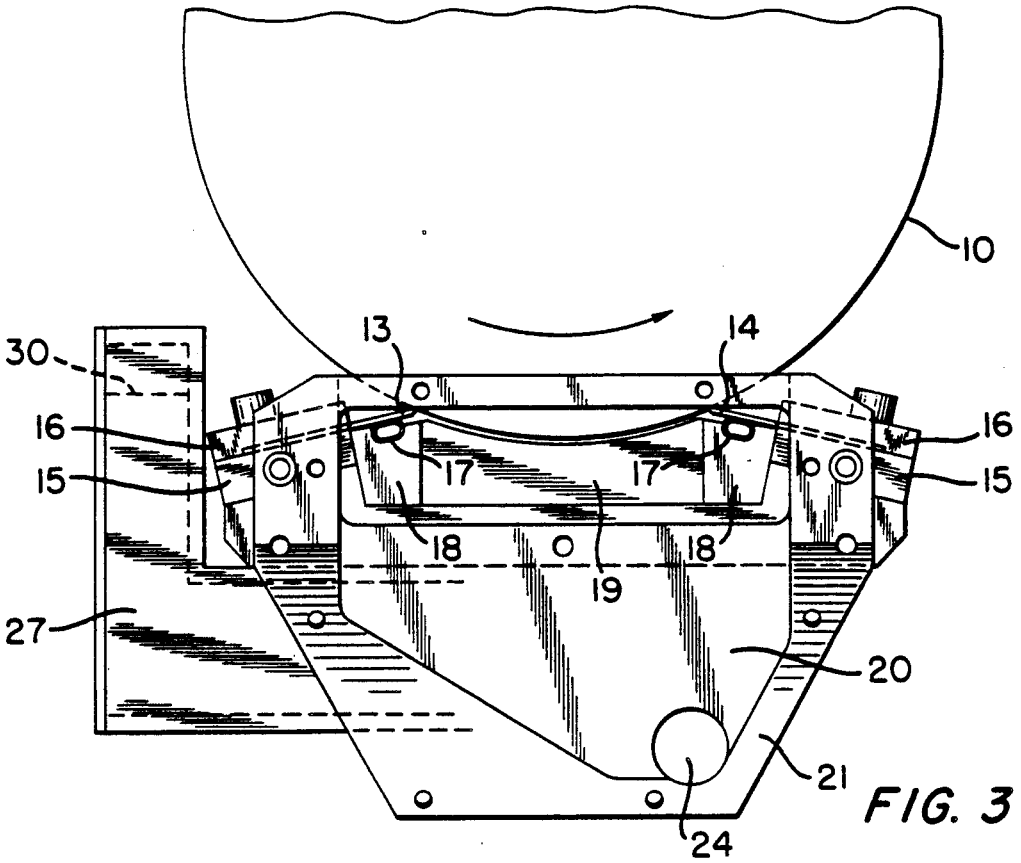
FIG. 3 is an end view of the ink fountain apparatus taken along the line 3—3 of FIG. 2 looking in the direction of the arrows and with the foreground cover removed from the end cap.
Figure 4:
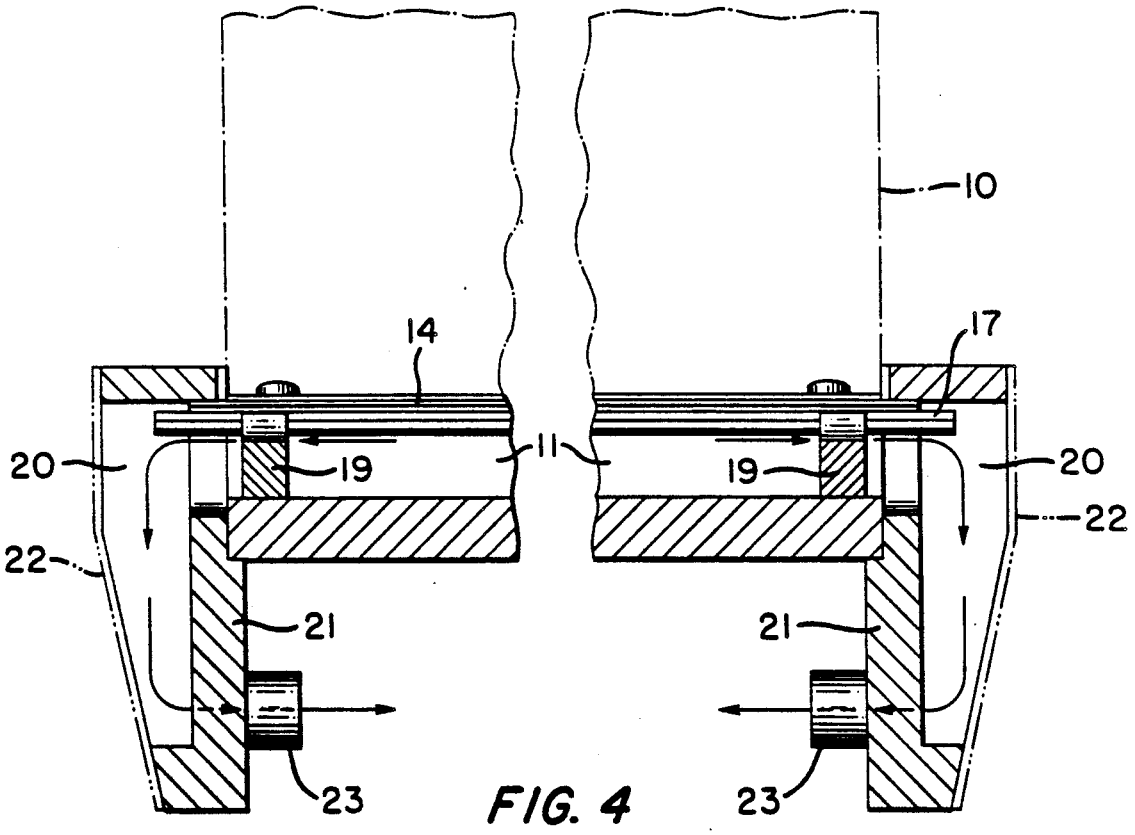
FIG. 4 is a cross-sectional view taken along the line of 4—4 of FIG. 2 looking in the direction of the arrows.

In the ink fountain apparatus of the present invention, ink is supplied to a rotating anilox cylinder 10 by an ink fountain 11 located beneath the cylinder and extending along at least the operative length of the cylinder. The ink is supplied continuously to the ink fountain from a storage reservoir from one or more passages 12 into the bottom of the ink fountain intermediate the ends thereof. The ink fountain has a pair of doctor blades 13, 14 arranged, respectively, along the upstream and downstream sides of the ink fountain. The doctor blade 13 wipes off any excess ink that has not been transferred to the plate cylinder and forms a puddle of ink which travels longitudinally between the doctor blade and the cylinder to opposite ends of the ink fountain. The reverse angle doctor blade 14 wipes the ink from the anilox cylinder surface allowing a film of ink to transfer to the plate cylinder (not shown). The excess ink travels along the blade parallel to the axis of the cylinder to opposite ends of the ink fountain.

The doctor blades 13, 14 are mounted on supports 15 and held in place by clamps 16. The unclamped, deflectable edges of the doctor blades are urged against the outer surface of the rotating cylinder by longitudinally extending fluid inflatable tubes 17 located beneath the unclamped, deflectable edges of the doctor blades on longitudinally extending tube supports 18 within the ink fountain.

The fluid pressure within the inflatable tubes 17 controls the pressure of engagement of the doctor blades against the rotating cylinder. The location of the tube supports 18 and the inflatable tubes thereon minimizes the amount of doctor blade area that is exposed to the pressure within the ink fountain so that pressure variations within the ink fountain have an insignificant effect on the wiping action of the doctor blades. Longitudinal grooves are preferably formed in the unclamped region of the doctor blades in proximity to the inner ends of the clamps 16 to act as hinges and facilitate the pressure control over the doctor blades. The pressures within the inflatable tubes, therefore, control wiping and metering forces which the doctor blades exert against the cylinder.

The inflatable tubes maintain each of the blade edges in the desired engagement with the outer surface of the cylinder. By minimizing the blade areas that are exposed to the ink fountain pressure, the "burping" problem is minimized. Moreover, it is possible to have one controlled pressure on the blade 14 and another controlled pressure on the blade 13 to reduce wipe forces and to minimize the wear of the blades and the anilox cylinder.

The ink level within the ink fountain is maintained by ink barriers 19 located at or near the ends of the fountain. These ink barriers do not contact either the anilox cylinder or the doctor blades. The upper ends of the ink barriers are closely spaced with respect to the outer periphery of the rotating cylinder and are of complementary shape so that a uniform gap is provided between the ink barriers and the cylinder to permit a constant flow of ink over the ink barriers into drain chambers 20 within end caps 21 mounted to each end of the ink fountain apparatus. Outer cover plates 22 are provided to close the drain chambers 20. The ink is returned to the ink storage reservoir through conduits 23 which communicate with the lower regions of the drain chambers 20 through discharge ports 24.

The ink barriers 19 permit a constant flow of ink to discharge from the ends of the ink fountain into the drain chambers 20. The doctor blades extend beyond the ends of the anilox cylinder and enter the end caps so that ink flowing longitudinally along the upper or lower surfaces of the doctor blades drains into the drain chambers 20 within the end caps 21.

Figure 5:
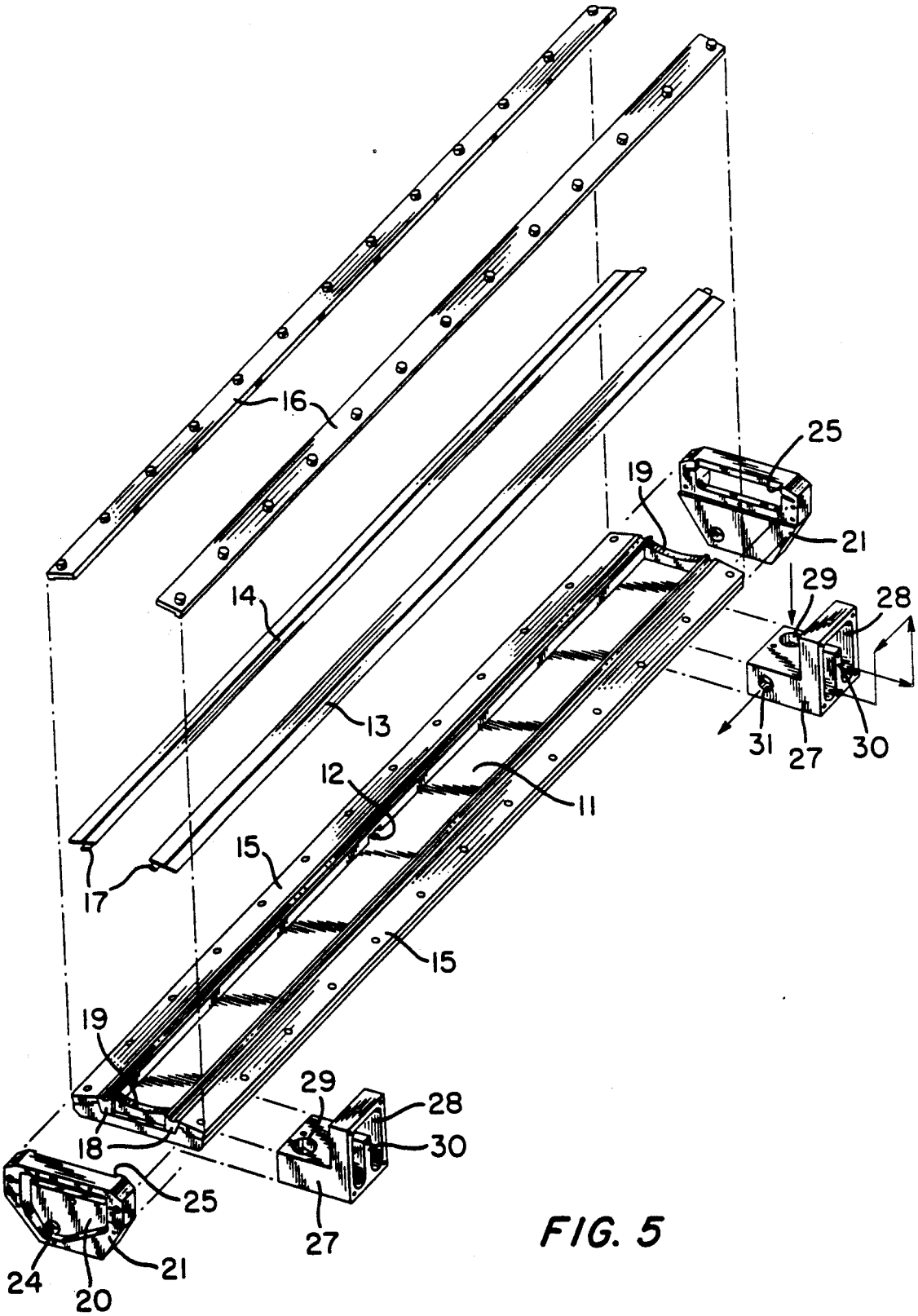
FIG. 5 is an exploded view of the components of the ink fountain apparatus shown in FIG. 1.

The end caps 21 ar designed to be mounted to the ends of the ink fountain. The upper ends of the end caps are slightly recessed at 25 (see FIG. 5) to receive the ends of the ink cylinder, leaving a small clearance between each end cap and the rotating cylinder. Because a constant flow of ink is maintained between the ink barriers and the cylinder and along the upper and lower unclamped surfaces of the doctor blades into the drain chamber, there is no tendency for the ink to dry. In this connection, the doctor blade clamps are machined so that the clamps and upper surfaces of the doctor blades form channels carrying the ink to the drain chambers within the end caps.

In order to minimize pressure variations in the ink fountain, a pressure control means is provided at both ends of the fountain. The pressure control means includes a block 27 containing a chamber 28 in communication with the ink reservoir through an inlet passage 29, and an overflow wall 30 within said chamber 28 for retaining ink on the upstream side of the wall within the chamber and for discharging ink on the downstream side of the wall through an outlet passage 31 which communicates with the storage reservoir. The upper ends of the overflow walls are higher than the upper overflow ends of the ink barriers so as to build up pressure within the ink fountain to maintain a controlled rate of flow of ink across the ink barriers.

In the operation of the ink fountain apparatus of the present invention, the reverse angle doctor blade 14 wipes and meters the ink onto the outer surface of the rotating cylinder which, in turn, transfers the ink to a plate cylinder (not shown). On the return side of the cylinder, the doctor blade 13 wipes off any excess ink that has not been transferred to the plate cylinder and forms a puddle of ink in the channel defined along the upper surface of the doctor blade 13 and the inner edge of the respective clamp. This ink travels longitudinally in both directions toward the end caps and drains into the draining chambers 20 therein.

Within the ink fountain a constant supply of ink is provided through the passage 12 so that the ink is applied to the surface of the rotating cylinder within the ink fountain. The ink within the fountain continuously flows across the ink barriers at opposite ends of the fountain into the drain chambers within the end caps for return to the ink reservoir. Excess ink also travels along the underside of the blade 14 parallel to the axis of the cylinder into the drain chambers within end caps.

A relatively uniform pressure is maintained within the ink fountain by the build-up of ink within the pressure chambers 28 on the upstream sides of the overflow walls 30. In this manner, relatively stable conditions are maintained within the ink fountain, overcoming the problems described above in connection with conventional prior art ink fountain apparatus.

The invention has been shown and described in preferred form and by way of example, and many variations and modifications can be made within the spirit of the invention. The invention, therefore, is not intended to be limited to any specified form or embodiment, except insofar as such limitations are expressly set forth in the claims.

We claim:

1. An ink fountain apparatus for supplying ink to a rotary cylinder of a printing press comprising an ink fountain adapted to be mounted beneath the cylinder, said ink fountain having upstream and downstream sides, a doctor blade clamped on each of the upstream and downstream sides and extending over the ink fountain to engage the cylinder, an overflow ink barrier at at least one end of the ink fountain and having an upper curved end adapted to be closely spaced to the cylinder to provide an overflow wall for the discharge of ink from the ink fountain, an end cap for the fountain and defining a drain chamber therein to receive the ink which overflows the ink barrier, doctor blade deflecting means beneath each doctor blade for urging the doctor blade upwardly against the cylinder, supports for said doctor blade deflecting means, said supports extending longitudinally within the ink fountain adjacent said upstream and downstream sides defining with the blades longitudinal channels for the discharge of ink into the drain chamber within said end cap.

2. An ink fountain apparatus as set forth in claim 1 in which the doctor blades and said longitudinal supports extend beyond the ink barrier in the direction of the drain chamber and are interposed between the ink barrier and sides of the ink fountain.

3. An ink fountain apparatus as set forth in claim 1 in which the doctor blade deflecting means is a fluid inflatable tube engageable with the doctor blade along the length thereof.

4. An ink fountain apparatus as set forth in claim 1 including pressure control means for controlling the rate of flow of ink across the ink barrier.

5. An ink fountain apparatus as set forth in claim 4 in which the pressure control means includes a chamber in communication with the ink fountain and an overflow wall within said chamber for retaining ink on an upstream side of the chamber in communication with the ink fountain and for discharging ink from the downstream side, the overflow wall within the chamber being higher than the overflow ink barrier so as to build up a controlled pressure in the ink fountain to control the rate of flow across the ink barrier.

6. An ink fountain apparatus for supplying ink to a rotary cylinder of a printing press comprising an ink fountain having upstream and downstream sides, means for clamping doctor blades on each side of the ink fountain, an overflow ink barrier at at least one end of the ink fountain and having an upper curved end adapted to be closely spaced to the cylinder to provide an overflow wall for the discharge of ink from the fountain, an end cap for the fountain and defining a drain chamber therein to receive ink which overflows the ink barrier, a pressure control chamber in communication with the ink fountain and an overflow wall within said chamber for retaining a level of ink within the chamber above the level of the ink discharged across the overflow ink barrier to provide a controlled pressure in the ink fountain and to control the rate of flow across the ink barrier.

* * * * *

UNITED STATES PATENT AND TRADEMARK OFFICE

CERTIFICATE OF CORRECTION

PATENT NO. : 5,085,144

DATED : Feb. 4, 1992

INVENTOR(S) : Lindstrom et al.

It is certified that error appears in the above-identified patent and that said Letters Patent is hereby corrected as shown below:

Col. 6, line 3, "fountain" should read --fountain adapted to be mounted beneath the cylinder, said ink fountain--.

Signed and Sealed this

Fourth Day of May, 1993

*Attest:*

Michael K. Kirk

MICHAEL K. KIRK

*Attesting Officer*

*Acting Commissioner of Patents and Trademarks*